US009689641B2

(12) United States Patent
Hamlin

(10) Patent No.: US 9,689,641 B2
(45) **Date of Patent: *Jun. 27, 2017**

(54) HANDS FREE CARRIER SYSTEM

(71) Applicant: Wade Hamlin, Ellensburg, WA (US)

(72) Inventor: Wade Hamlin, Ellensburg, WA (US)

( * ) Notice: Subject to any disclaimer, the term of this patent is extended or adjusted under 35 U.S.C. 154(b) by 70 days.

This patent is subject to a terminal disclaimer.

(21) Appl. No.: 14/846,263

(22) Filed: Sep. 4, 2015

(65) Prior Publication Data

US 2016/0187096 A1 Jun. 30, 2016

Related U.S. Application Data

(63) Continuation-in-part of application No. 14/170,960, filed on Feb. 3, 2014, now Pat. No. 9,127,901.

(60) Provisional application No. 61/896,889, filed on Oct. 29, 2013.

(51) Int. Cl.

| | |
|---|---|
| ***F41B 5/14*** | (2006.01) |
| *A45F 5/02* | (2006.01) |
| *A45F 3/14* | (2006.01) |

(52) U.S. Cl.

CPC ..... *F41B 5/1461* (2013.01); *A45F 2003/146* (2013.01); *A45F 2005/026* (2013.01)

(58) Field of Classification Search

CPC ..... A45F 2005/026; A45F 2005/025; A45F 5/02; A45F 5/021; F41B 5/063; F41B 5/1461; Y10S 24/60

USPC ..... 224/197, 667, 916, 242

See application file for complete search history.

(56) References Cited

U.S. PATENT DOCUMENTS

| | | | | |
|---|---|---|---|---|
| 2,261,476 A | | 11/1941 | Kiefer | |
| 4,121,743 A | * | 10/1978 | Burton | F41B 5/1461 124/88 |
| 4,327,452 A | | 5/1982 | Swatzell | |
| 4,669,132 A | | 6/1987 | Courson | |
| 4,889,307 A | * | 12/1989 | Klansek | F41B 5/14 124/88 |
| 5,201,858 A | * | 4/1993 | Otrusina | A45F 5/02 224/197 |
| 5,393,297 A | | 2/1995 | Kristoff | |
| 5,620,120 A | * | 4/1997 | Tien | A45F 5/02 224/194 |
| 5,957,421 A | * | 9/1999 | Barbour | A45F 5/02 224/197 |

(Continued)

*Primary Examiner* — Adam Waggenspack
(74) *Attorney, Agent, or Firm* — Dean A. Craine, P.S.

(57) ABSTRACT

A hands free carrier system that enables a hunter to easily and quickly accessed a hunting bow that is carried in a protected, hands-free manner. The system includes a bow with a mounting peg, a waist belt or chest harness mounted holster with an interior pocket that includes a vertically receiver slot. The mounting peg is attached to the bow in an offset location from its center axis so the bow automatically hangs with its longitudinal axis vertically aligned adjacent to the hunter's waist or back when attached to the holster. The peg includes a wide head attached to a narrow post. During use, the bow is positioned over the holster so the peg is oriented over the receiver slot in the holster. When the bow is moved downward, the peg slides into the receiver slot and captures the wide head. In another embodiment, the holster includes a rotating locking disc that engages the wide head that requires a combination movement of rotation and lifting of the bow in order to bow from the holster.

19 Claims, 9 Drawing Sheets

(56) References Cited

U.S. PATENT DOCUMENTS 6,513,176 B1 2/2003 Najar

* cited by examiner

HANDS FREE CARRIER SYSTEM

This is a continuation patent application based upon and claims the filing date benefit of U.S. utility patent application (application Ser. No. 14/170,960) filed on Feb. 3, 2014 which claims the filing date benefit of U.S. provisional patent application (Application No. 61/896,889) filed on Oct. 29, 2013.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to systems used to manually carry bows when hiking or horseback riding in the wilderness, and more a particularly to such systems that allows the user to easily carry a bow in a hands-free stored position and then quickly access the bow from the stored position.

2. Description of the Related Art

Bow hunters must transport their bows long distances into the wilderness when hunting. Because the bows are large and fragile, special precautions must be taken to protect the bow from impacts against rocks, shrubs and trees.

Some hunters will carry their bows in backpacks. When the hunter sees a potential target, he or she must quietly dismount the backpack and unpack the bow. Dismounting the backpack and unpacking the bow can take several seconds giving the target sufficient time to move out of range.

What is needed is a hands-free bow carrier system that enables a bow to be carried by a hunter in a protected, easy to access location on the hunter's body. What is also needed is a bow carrier system that enables the hunter to easily insert or quickly remove from the bow from the protected location without visual aid or precise physically manipulation.

SUMMARY OF THE INVENTION

Disclosed herein is a bow carrier system that allows a hunter to carry a bow in a hands-free, vertically aligned position either against the user's side or back. The system includes a holster with a self-aligning receiver slot and a mounting peg attached to the bow. The holster is mounted over the user's back or waist. During use, the bow is oriented over the holster to allow the mounting peg to slide vertically into and engage the receiver slot on the holster.

The mounting peg is attached at a non-critical location on the bow near or at the bow's center axis so that the bow automatically rotates and hangs in a vertical alignment against the hunter's body when the mounting peg is captured by the receiver slot. The mounting peg includes a wide head attached to a narrow post. The post may be attached to one leg on an L-shaped peg clip. The opposite leg on the peg clip is attached to the bow and oriented so the post extends substantially perpendicular from the mounting surface of the bow.

The holster includes a front layer and a rear layer with an interior pocket located between them designed to receive the head of the peg when the peg is inserted into the receiver slot. In one embodiment, the front layer of the holster has a V or U-shaped, downward converging top opening with narrow, centrally aligned vertical receiver slot.

The holster includes a means for preventing lateral movement of said peg when inserted into said receiver slot. In one embodiment, the width of the receiver slot is slightly larger than the post and slightly smaller in width than the head. During use, the bow is aligned over the receiver slot so the post on the mounting peg is aligned over the slot and the head of the peg is positioned in the interior pocket. When the bow is forced downward, the post on the mounting peg enters and slides into the receiver slot and the head is retained inside the interior pocket. When proper seated, the head is captured and held inside the interior pocket.

In another embodiment of the holster, called a locking holster, the means for locking is a rotating locking disc mounted inside the interior pocket. The locking disc includes a plurality of partially opened curved cutouts radially aligned along its perimeter edge. A circular opening is formed on the holster's front layer. The locking disc is coaxially aligned with and slightly larger in diameter than the circular opening. In one embodiment, the locking disc is made of thin plastic or nylon material and is positioned adjacent to the front layer of the locking holster thereby creating an interior pocket or an empty space inside the pocket behind the locking disc. In one embodiment, the cutouts formed on the locking disc are sufficiently wide to receive the head of the peg. In another embodiment, the cutouts are sufficiently wide to receive the post.

During use, the bow is oriented vertically over the second embodiment of the locking holster so the mounting peg is aligned over the receiver slot. The bow is then forced downward into the locking holster forcing the post into the receiver slot and into the upper cutout formed on the locking disc. When additional downward force is applied to the bow and simultaneously pulled slightly forward or rearward, the head and peg are forced against the upper cutout causing the rotating disc to rotate either clockwise or counter-clockwise thereby moving the slot and the peg away from the receiver slot. If the bow is accidentally hit or forced upward when attached to the holster, the misalignment of the cutout and the pin with the receiver slot prevents the bow from being dislodged. To remove the bow from the locking holster, the bow must be manipulated to rotate the disc and align the cutout containing the pin with the receiver slot and then the bow must be lifted to remove the head of the pin from the cutout. Because both movements are required to remove the bow from the holster, accidental dislodgement of the bow from the locking holster is unlikely.

DESCRIPTION OF THE PREFERRED EMBODIMENT(S)

Figure 1:
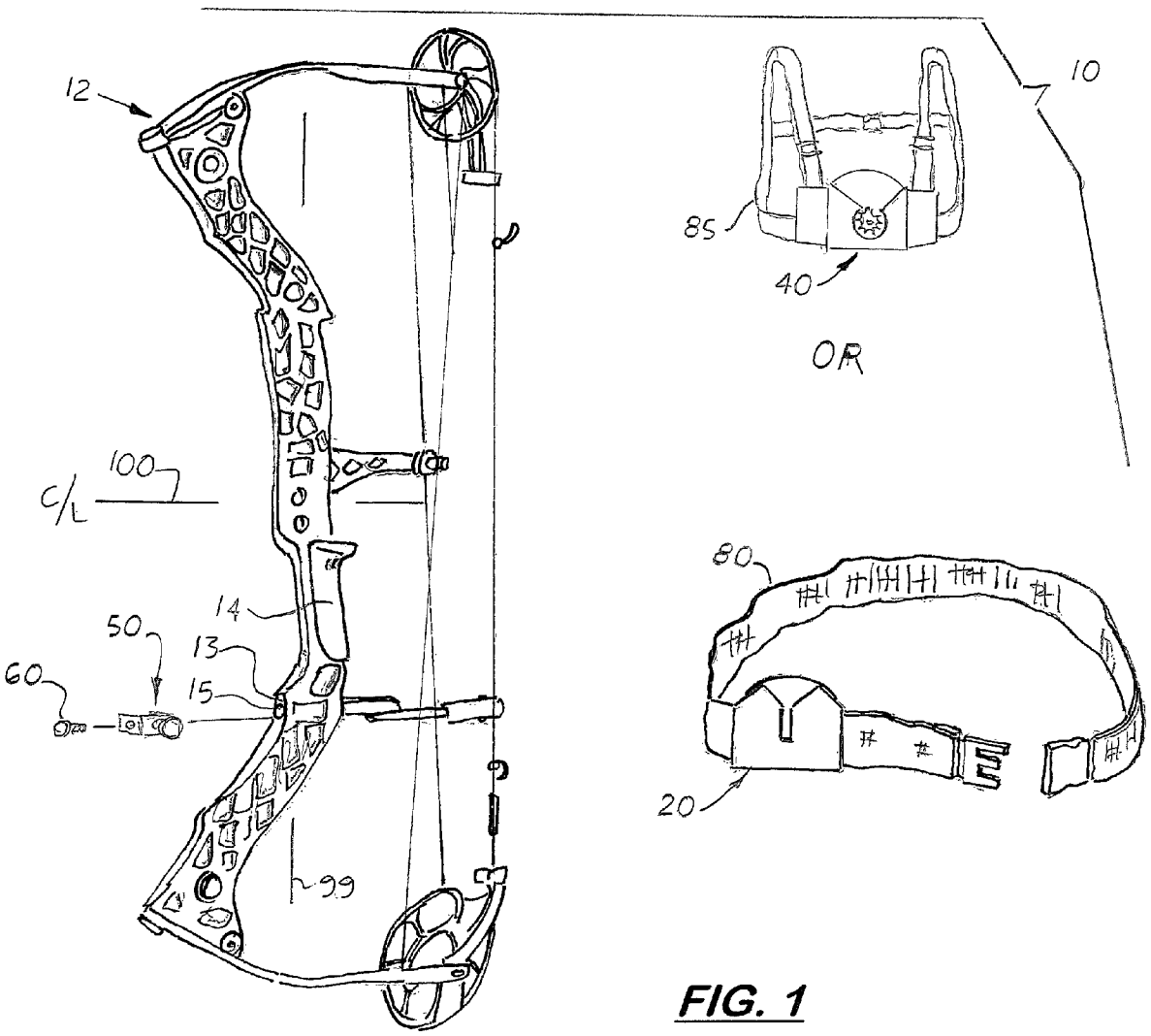
FIG. 1 is an illustration of the bow carrier system that includes a bow, a peg clip attached to the bow, a belt or harness and one or two possible holsters attached to the belt or holster.

In the accompanying Figs there is disclosed is a bow carrier system 10 that allows a hunter 90 to carry a bow 12 in a hands-free vertically aligned position either against the user's waist 92 or back 94. The system includes one of two possible holsters—a slotted holster 20 with a vertical receiver slot 30 or a locking holder 40 with a wide top opening with a rotating locking disc 70. The slot 30 or the locking disc 70 are designed to receive a T-shaped mounting peg 50 securely attached to the bow 12.

Figure 2:
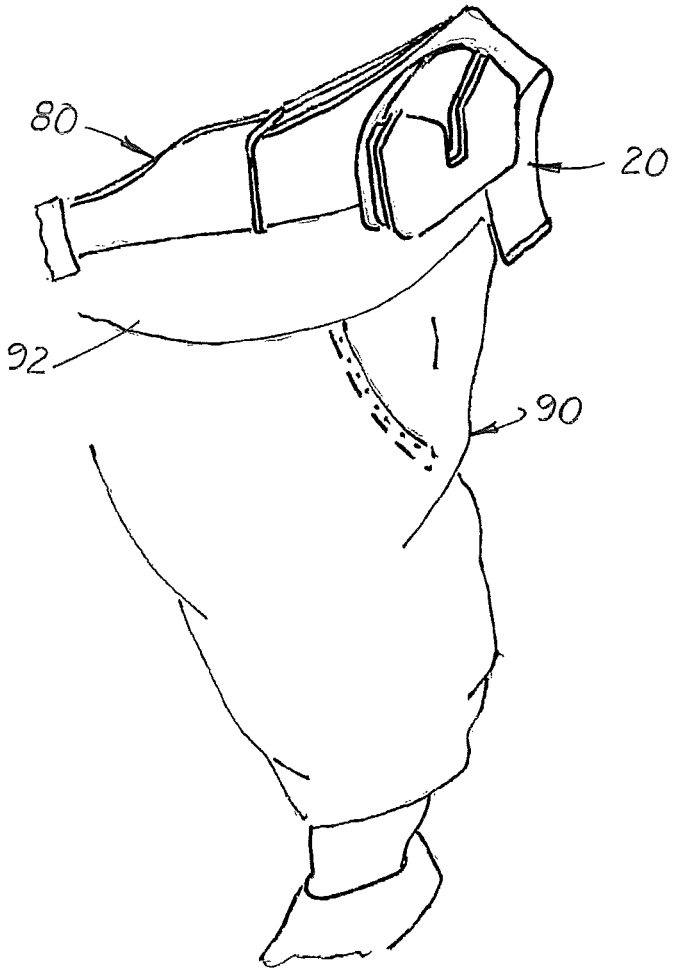
FIG. 2 is an illustration of the slotted holster mounted on a waist belt.
Figure 3:
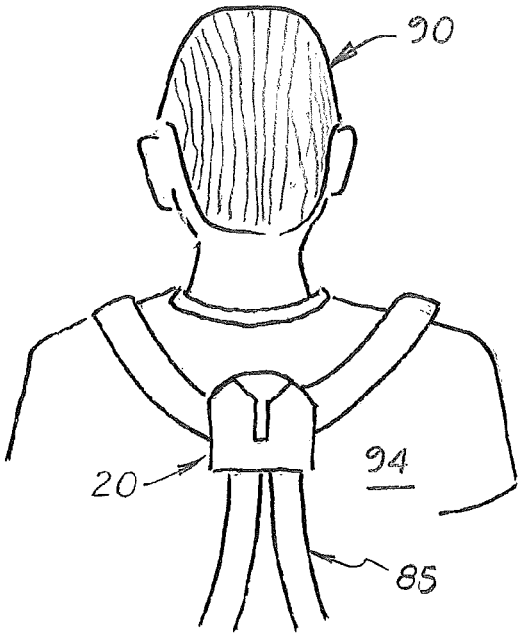
FIG. 3 is an illustration of a slotted holster mounted on a back harness.
Figure 4:
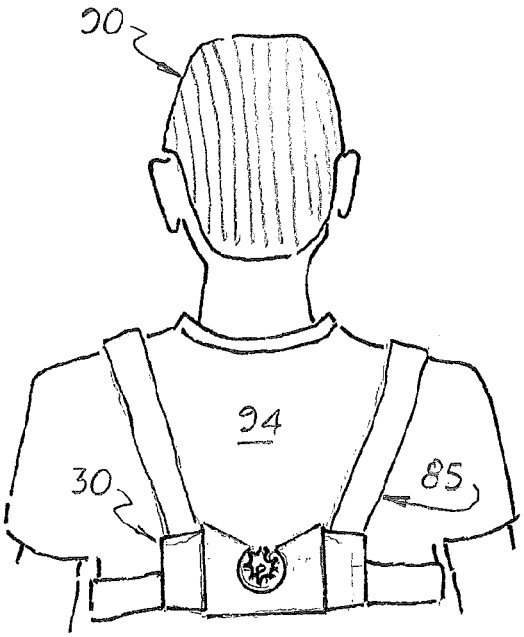
FIG. 4 is an illustration of a locking holster mounted on a back harness.

Besides two types of holsters 20, 40, there are two types of body supporting structures—a waist belt 80 and a back harness 85. FIG. 2 is an illustration of the slotted holster 20 mounted on a waist belt 80. FIG. 3 is an illustration of a slotted holster 20 mounted on a back harness 85. FIG. 4 is an illustration of a locking holster 40 mounted on a back harness 85 and FIG. 7 is an illustration of a locking holster 40 mounted on a waist belt 80.

Figure 5:
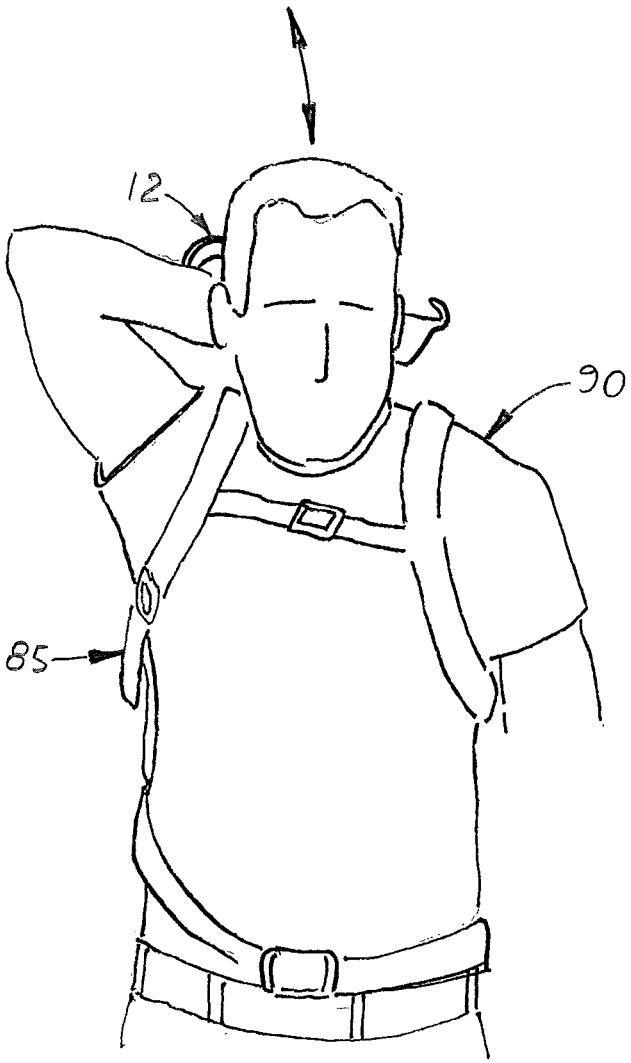
FIG. 5 is an illustration of a hunter inserting a bow into a holster on a back harness.
Figure 6:
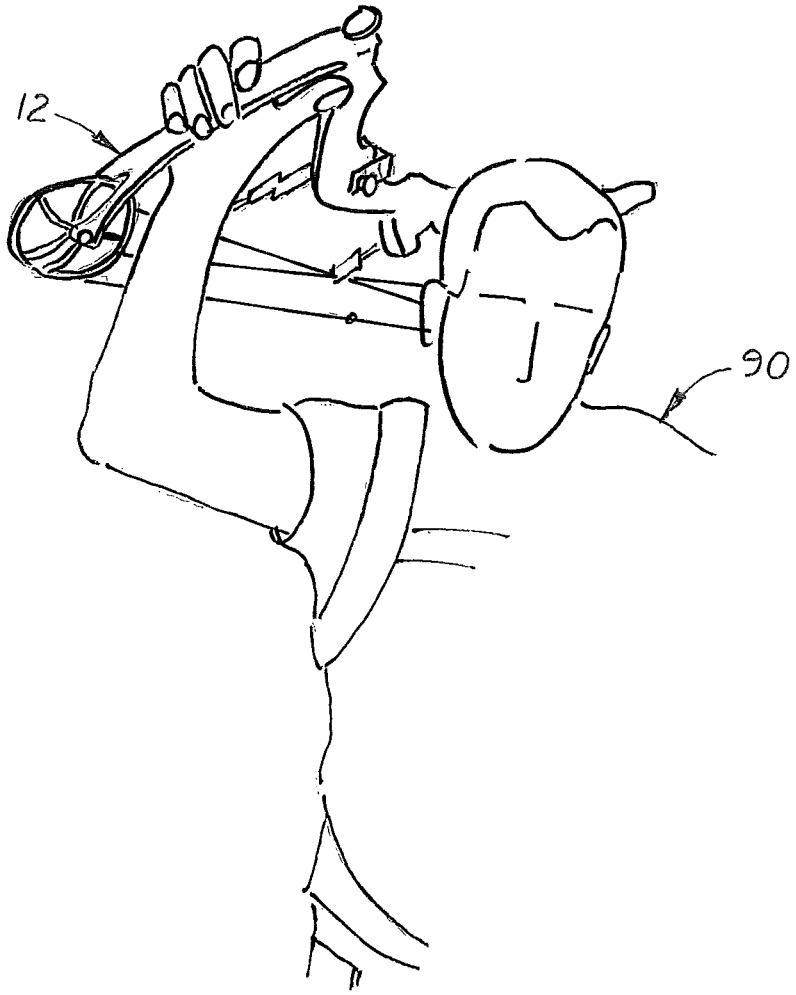
FIG. 6 is an illustration of a hunter removing a bow from a holster on a back harness.

When the holsters 20 and 40 are used with the waist belt 80, the bow 12 is vertically aligned against the hunter's waist 92. The bow 12 is turned so the mounting peg 50 faces the hunter's waist. When the holsters 20 and 40 are used with the back harness 85, the bow 12 is stored in a vertical orientation over the hunter's back 94 has shown in FIGS. 5 and 6.

Figure 7:
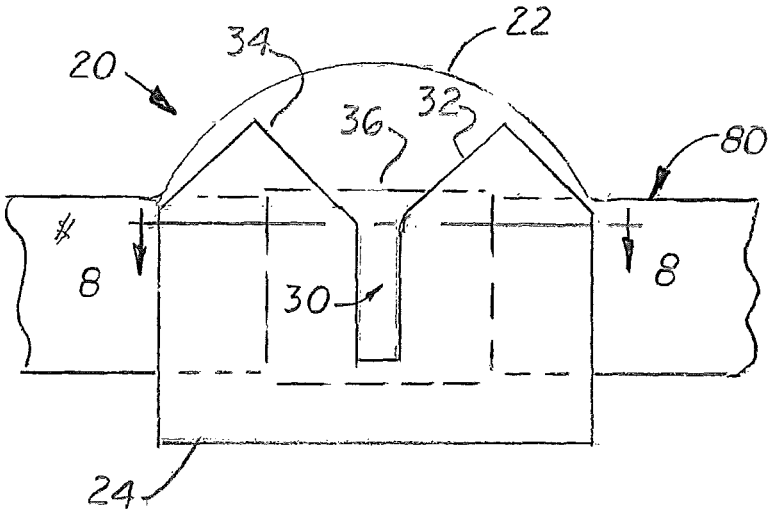
FIG. 7 is a front elevational view of a slotted holster attached to a waist belt.
Figure 8:
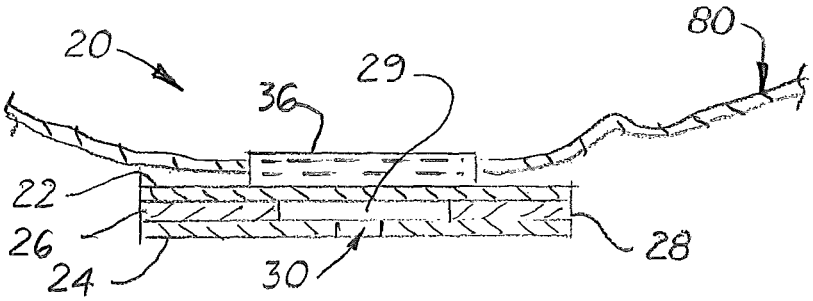
FIG. 8 is a top plan view of the slotted holster shown in FIG. 7.

FIGS. 7 and 8 show a slotted holster 20 that includes a vertical receiver slot 30 formed on a front layer 24 attached along its lower and side perimeter edges to a back layer 22. Formed in between the back layer 22 and the front layer 24 are two intermediate spacer layers 26, 28. Formed in between the two spacer layers 26, 28 is an interior pocket 29. Attached to the rear surface of the back layer 22 is an optional belt clip 36. The two top edges 32, 34 of the outer layer 24 converge towards the receiver slot 30.

Figure 12:
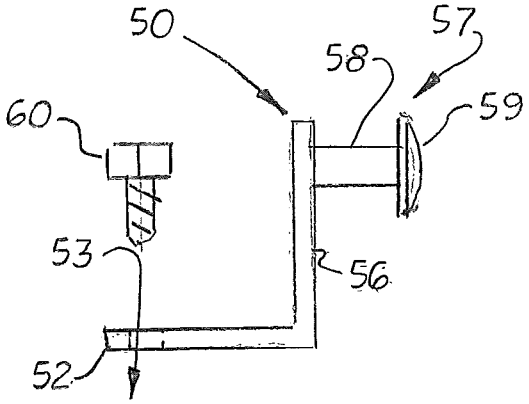
FIG. 12 is a side elevational view of the peg clip.
Figure 13:
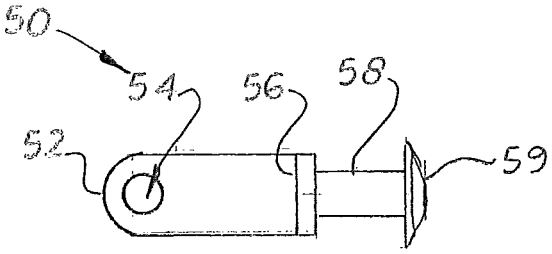
FIG. 13 is a top plan view of a peg clip.

As shown in FIG. 1, the mounting peg 50 is attached to the bow 12 in an offset location from the bow's center of gravity so the bow 12 automatically rotates and hangs with its longitudinal axis 99 vertically aligned. As shown in FIGS. 12 and 13, the mounting peg 57 is attached to a L-shaped clip 50 with a first leg 52 and a perpendicularly aligned second leg 56. A hole 53 is formed on the first leg 52 in which a mounting bolt 60 is extended to connect the clip 50 to a thick, non-critical surface 13 on the bow 12. A thick non-critical surface 13 is normally located on a rear surface on the bow 12 below the bow's center axis 100 and the bow's grip handle 14. Often the lateral surface on a bow 12 includes threaded bores 15 designed to attach to various accessories commonly attached to a bow 12. The clip 50 may be attached to one of these bores 15.

The mounting peg 57 includes a post 58 and a perpendicularly wide head 59. The post 58 is perpendicularly aligned and extends outward from the second leg 56. The clip 50 is rotated on the bow 12 so the peg 57 extends outward from the side of the bow 12 as shown in FIG. 1. The post 58 is slightly smaller than the slot 30 formed on the holster 20, and the head 59 is slightly larger in diameter than the slot 30. During use, the bow 12 is oriented over the holster 20 so the post 58 slides freely into the receiver slot 30 and the head 59 is retained inside the pocket 29. When the bow 12 is forced downward, the post 58 and head 59 are captured and lateral movement from the holster 20 is prevented. Because the post 58 is circular in cross-section, the bow 12 may rock back and forth when attached to the holster 20.

Figure 9:
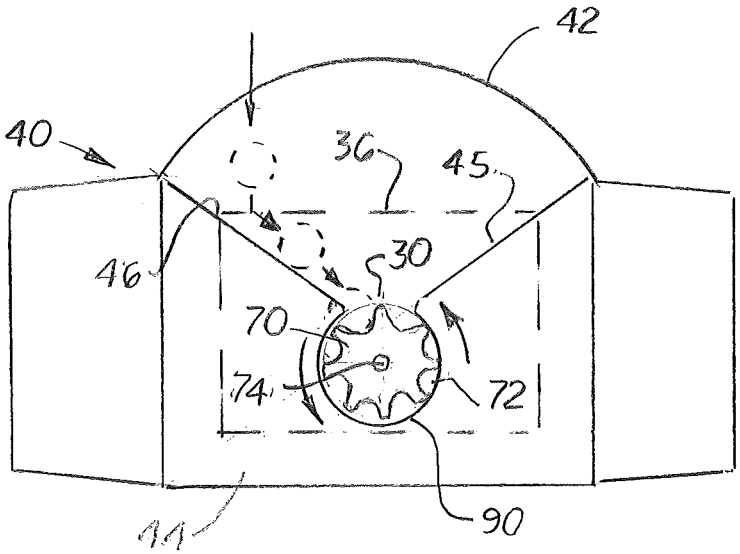
FIG. 9 is a front elevational view of the locking holster attached to waist belt.
Figure 10:
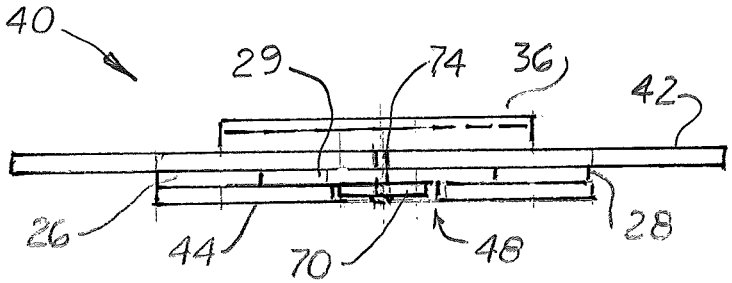
FIG. 10 is a top plan view of a locking holster shown in FIG. 9.
Figure 11:
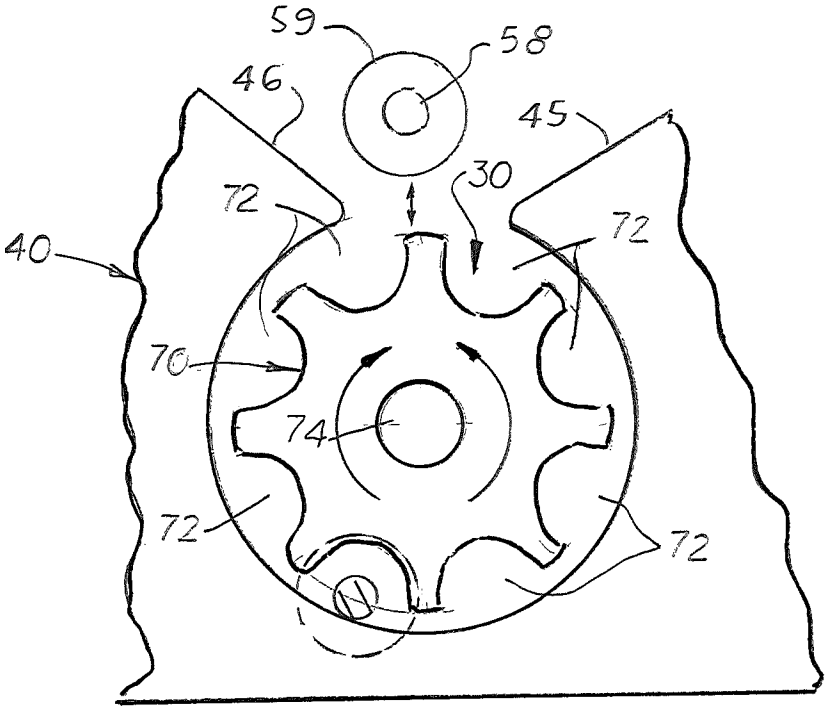
FIG. 11 is a front plan view of a locking holster showing a peg being inserted to a partially closed cutout on the rotating disc and the then automatically rotated to move the peg to the lowest position.

FIGS. 9-10 show a locking holster 40 that includes a vertical receiver slot 30 formed on a front layer 44 attached along its lower and side perimeter edges to a back layer 42. Formed in between the back layer 22 and the front layer 24 are two intermediate spacer layers 26, 28. Formed in between the two spacer layers 26, 28 is an interior pocket 29. Attached to the rear surface of the back layer 42 is an optional belt clip 36. The two top edges 45, 46 of the outer layer 44 converge towards the receiver slot 30.

On the locking holster 40, the holster's front layer 44 includes a receiver slot 30 and a lower circular opening 90. Located inside the locking holster 40 is a rotating locking disc 70 with a plurality of radially aligned curved cutouts 72 formed around the disc's perimeter edge. The rotating disc 70 is mounted to the holster's rear layer 22 with a pin 74 and is coaxially aligned with the circular opening 90. Located inside the locking holster 40 and behind the rotating disc 70 is a narrow interior pocket 29. In one embodiment, the locking slots 72 are configured to receive the head 69 on the mounting peg 57. The circular opening 90 is slightly smaller in diameter than the locking disc 70. It should be understood, however that the locking slots 72 may be configured to receive the post 58 so the head 59 is positioned behind the locking disc 70. In this embodiment, the circular opening 90 would be slightly larger in diameter than the locking disc 70.

During use, the bow 12 is oriented so the head 59 on the mounting peg 57 fits into the interior pocket 29 and the post 58 fits into one of the curved slots 72. Any downward force exerted on the bow 12, causes the locking disc 70 to rotate in the holster 40 and repositions the locking slot 72 containing the head 59 (or post 58) of the pin 57 to an offset location from the receiver slot 30. Normally, the offset location is located opposite the receiver slot 30. To remove the head 59 (or post 58) from the locking slot 72, the bow 12 and the peg 58 must be simultaneously rotated and lifted.

If the holster 40 is mounted on a waist belt 80, the peg 57 is captured by the holster and able to rotate in a fore and aft direction if impacted by an object when walking. If the holster 40 is mounted on a shoulder or a back or chest harness, the other objects carried on the chest or back usually prevent rotation of the bow.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A hands free carrying system, comprising;

a. a human body support carrier;

b. holster attached to said human body supported carrier, said holster includes a front layer, an interior pocket, a top opening to said interior pocket and a vertically aligned receiver slot that communicates with said top opening, said receiver slot configured to receive a post, an opening formed on said front layer located below said receiver slot and a rotating locking disc located behind said front layer and coaxially aligned with said opening, said locking disc includes a plurality of radially aligned cutouts formed on its perimeter surface; and, b. a mounting peg mounted on an object to be carried, said mounting peg configured to slide into said receiver slot and into one of said cutouts formed on said locking disc and held on said holster when said locking disc is rotated so that said one of said cutouts is misaligned with said receiver slot.

2. The carrier system, as recited in claim 1, wherein said a human body supported carrier is a belt.

3. The carrier system, as recited in claim 1, wherein said human body supported carrier is a shoulder or back or chest harness.

4. The carrier system, as recited in claim 1, wherein said mounting peg includes an L-shaped clip that selectively attaches to said object to be carried.

5. The carrier system, as recited in claim 1, wherein said mounting peg includes a post and a head wider than said post, said receiver slot configured to receive said post and prevent the removal of said head thereby preventing lateral movement and disengagement of said peg from said holster when said mounting peg is inserted into said receiver slot.

6. The carrier system, as recited in claim 1, wherein said receiver slot holster includes an opening formed on said front layer located below said receiver slot and a rotating locking disc located behind said front layer and coaxially aligned with said opening, said locking disc includes a plurality of radially aligned cutouts formed on its perimeter surface that capture said mounting peg when aligned with said receiving slot.

7. The carrier system, as recited in claim 5, wherein said a body supported carrier is a belt.

8. The carrier system, as recited in claim 5, wherein said a body supported carrier is a shoulder harness, a back harness or a chest harness.

9. The carrier system, as recited in claim 5, wherein said object includes a flat mounting surface upon which said mounting clip is attached.

10. The carrier system, as recited in claim 1 wherein said mounting peg is an L-shaped clip with two legs with a post perpendicularly aligned with one of said legs.

11. The carrier system, as recited in claim 1, wherein each said receiver slot on said locking disc is configured to capture said head on said peg and said opening is configured to prevent lateral movement of said peg from said slot opening when said mounting peg is misaligned with said receiver slot.

12. The carrier system, as recited in claim 11, wherein said mounting peg is an L-shaped clip with two legs and with a perpendicular aligned peg attached to one of said legs.

13. A hands free carrying system, comprising;

a. an object with a longitudinal axis and a mounting surface;

b. a mounting peg mounted on said mounting surface of said object, said mounting peg includes a post attached to said object and a head aligned on a post;

c. a carrier;

d. holster attached to said carrier, said holster including an interior pocket formed between them, said holster also includes a top opening that communicates with said interior pocket and a receiver slot, said holster also includes an opening located below and communicating with said receiver slot; and, e. a rotating locking disc located inside said interior pocket and coaxially aligned with said opening, said locking disc includes at least one locking cutout formed on its perimeter surface configured to receive said peg.

14. The carrier system, as recited in claim 13, wherein said locking disc is slightly larger than said opening on said holster thereby prevent preventing lateral movement and disengagement of said peg from said cutout when said peg is inserted into said cutout and when said locking disc is rotated and said cutout in a misaligned position relative to said receiver slot.

15. The carrier system, as recited in claim 13, wherein said body supported carrier is a belt.

16. The carrier system, as recited in claim 13, wherein said body supported carrier is a shoulder harness a back harness, or a chest harness.

17. The carrier system, as recited in claim 13, wherein said mounting peg includes a L-shaped clip that selectively attaches to said object.

18. The carrier system, as recited in claim 1, wherein said object is a bow.

19. The carrier system, as recited in claim 13, wherein said object is a bow.

* * * * *